US006502011B2

(12) United States Patent
Haag

(10) Patent No.: US 6,502,011 B2
(45) Date of Patent: Dec. 31, 2002

(54) METHOD AND APPARATUS FOR PRESENTING AND MANAGING INFORMATION IN AN AUTOMATED PARKING STRUCTURE

(76) Inventor: Gerhard Haag, 12812 N. 60th St., Pinellas, FL (US) 33760

( * ) Notice: Subject to any disclaimer, the term of this patent is extended or adjusted under 35 U.S.C. 154(b) by 0 days.

(21) Appl. No.: 09/812,416

(22) Filed: Mar. 20, 2001

(65) Prior Publication Data

US 2002/0018704 A1 Feb. 14, 2002

Related U.S. Application Data

(63) Continuation-in-part of application No. 09/364,934, filed on Jul. 30, 1999.

(51) Int. Cl.[7] ..... G06F 7/00

(52) U.S. Cl. ..... 700/217; 700/213; 414/231; 414/232; 414/234; 340/932.2; 345/700; 345/810

(58) Field of Search ..... 700/213, 217; 414/227, 231, 232, 233, 234–264; 340/932.2; 345/810, 905, 700

(56) References Cited

U.S. PATENT DOCUMENTS 4,603,390 A * 7/1986 Mehdipour et al. ..... 364/467
5,383,757 A * 1/1995 Takaoka et al. ..... 414/240
5,432,508 A * 7/1995 Jackson ..... 340/932.2
5,530,942 A 6/1996 Tzou et al.
D376,601 S 12/1996 Wooldridge
5,706,448 A 1/1998 Blades
5,877,704 A * 3/1999 Yoshida ..... 340/932.2
5,894,305 A 4/1999 Needham
5,896,133 A 4/1999 Lynch et al.
5,898,431 A 4/1999 Webster et al.
5,898,436 A 4/1999 Stewart et al.
5,940,481 A * 8/1999 Zeitman ..... 379/114
5,982,383 A * 11/1999 Kumar et al. ..... 345/440
6,059,229 A * 5/2000 Luria ..... 244/118.1
6,085,124 A * 7/2000 Choi ..... 700/217
6,147,624 A * 11/2000 Clapper ..... 340/932.2
6,154,685 A * 11/2000 Kim ..... 700/217
6,340,935 B1 * 1/2002 Hall ..... 340/932.2

* cited by examiner

*Primary Examiner*—Khoi H. Tran
(74) *Attorney, Agent, or Firm*—Arter & Hadden LLP

(57) ABSTRACT

A method and system for monitoring and controlling an automated parking system using a graphical user interface is described. The described method includes the step of displaying a graphical representation of a floor of an automated parking garage. The method also includes the step of displaying a number of objects in relation to the floor. The method further includes the step of displaying a plurality of control objects. A system for implementing the steps of the method is also described.

28 Claims, 16 Drawing Sheets

METHOD AND APPARATUS FOR PRESENTING AND MANAGING INFORMATION IN AN AUTOMATED PARKING STRUCTURE

CROSS-REFERENCE TO RELATED APPLICATIONS

This application is a Continuation-In-Part of U.S. Ser. No. 09/364,934 entitled "Method and Apparatus for Distributing and Storing Pallets in an Automated Parking Structure" filed Jul. 30, 1999, which is incorporated by reference in its entirety, herein.

FIELD OF THE INVENTION

The present invention is concerned with the field of automated parking systems. More specifically, the present invention is concerned with a method and apparatus for presenting and managing information in an automated parking structure.

BACKGROUND OF THE INVENTION

Automated mechanical parking garage systems have been employed since the late 1950's. Early automated parking garages utilized crane systems, conveyors, hydraulics and pneumatics to transport and store vehicles within a parking structure. Recently, more advanced systems have been developed which include computer-controlled, specialized equipment for carrying vehicles to assigned parking spaces in much the same way that computerized assembly lines or warehouses store and retrieve miscellaneous goods.

Examples of automated parking garage systems are described in U.S. Pat. No. 5,467,561 of Takaoka, U.S. Pat. No. 5,556,246 of Broshi, U.S. Pat. No. 5,573,364 of Schneider, et al., and U.S. Pat. No. 5,669,753 of Schween.

Since the early 1980's, many computer-based systems have employed a graphical user interface ("GUI") to present and receive information from a user or operator. In many cases, such a graphical user interface is little more than an alternative expression of a traditional interface. For example, certain operating systems employing a graphical user interface collect and display substantially the same information as traditional text-based operating systems.

Although both automated parking technology and GUI technology have co-existed for the last twenty years, there are no known GUIs for applications which control the operation of an automated parking system. Moreover, there are no user interfaces, graphical or not, which present the status of the components in an automated parking system in an intuitive and unambiguous way suitable for a novice operator.

Accordingly, there is a need for a method and apparatus which address the shortcomings of the prior art. Specifically, there is a need for a method and apparatus which presents and manages information in an automated parking garage in an intuitive and unambiguous way, enabling even a novice operator to understand the status of the components of the automated parking system. Further, there is a need for a system which graphically provides alerts regarding the status of components of an automated parking system and enables an operator to take corrective action using the same display presenting the alert.

SUMMARY OF THE INVENTION

The present invention is a method and system for monitoring and controlling an automated parking system using a graphical user interface. The method of the present invention includes the step of displaying a graphical representation of a floor of an automated parking garage. The method also includes the step of displaying a number of objects in relation to the floor. In this way, the present invention represents the entire state of the automated parking garage.

The objects displayed in relation to the floor approximate the actual physical layout of the floor and may include an entry/exit station, a module for transporting a vehicle along an x-axis, a module for transporting a vehicle along a y-axis, a module for transporting a vehicle along a z-axis and vehicle storage racks. In some cases, duplicate elements may be displayed to accurately depict the floor layout. For example, three exit/entry station objects may be displayed to represent a floor having three entry/exit stations.

The method of the present invention further includes the step of displaying a plurality of control objects. Each control object is associated with controlling an aspect of the automated parking system. For example, a control object may be a graphical button used to start or stop a physical process. Of course, an object displayed in relation to the floor may also act as a control object. For example, a vertical lift conveyor object may be selected by an operator to monitor or control the operation of a physical vertical lift conveyor.

Accordingly, it is an object of the present invention to reduce the training time required for an operator of an automated parking garage. An advantage of the present invention is that it enables a novice operator to monitor and control the operation of an automated parking garage, and a feature of the present invention is that it presents information and receives commands in an intuitive fashion. These objects, advantages and features improve the performance of the automated parking garage under the control of a novice operator.

For a better understanding of the present invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure.

Accordingly, other objects and a fuller understanding of the invention may be obtained by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DESCRIPTION OF THE PREFERRED EMBODIMENT

Figure 1:
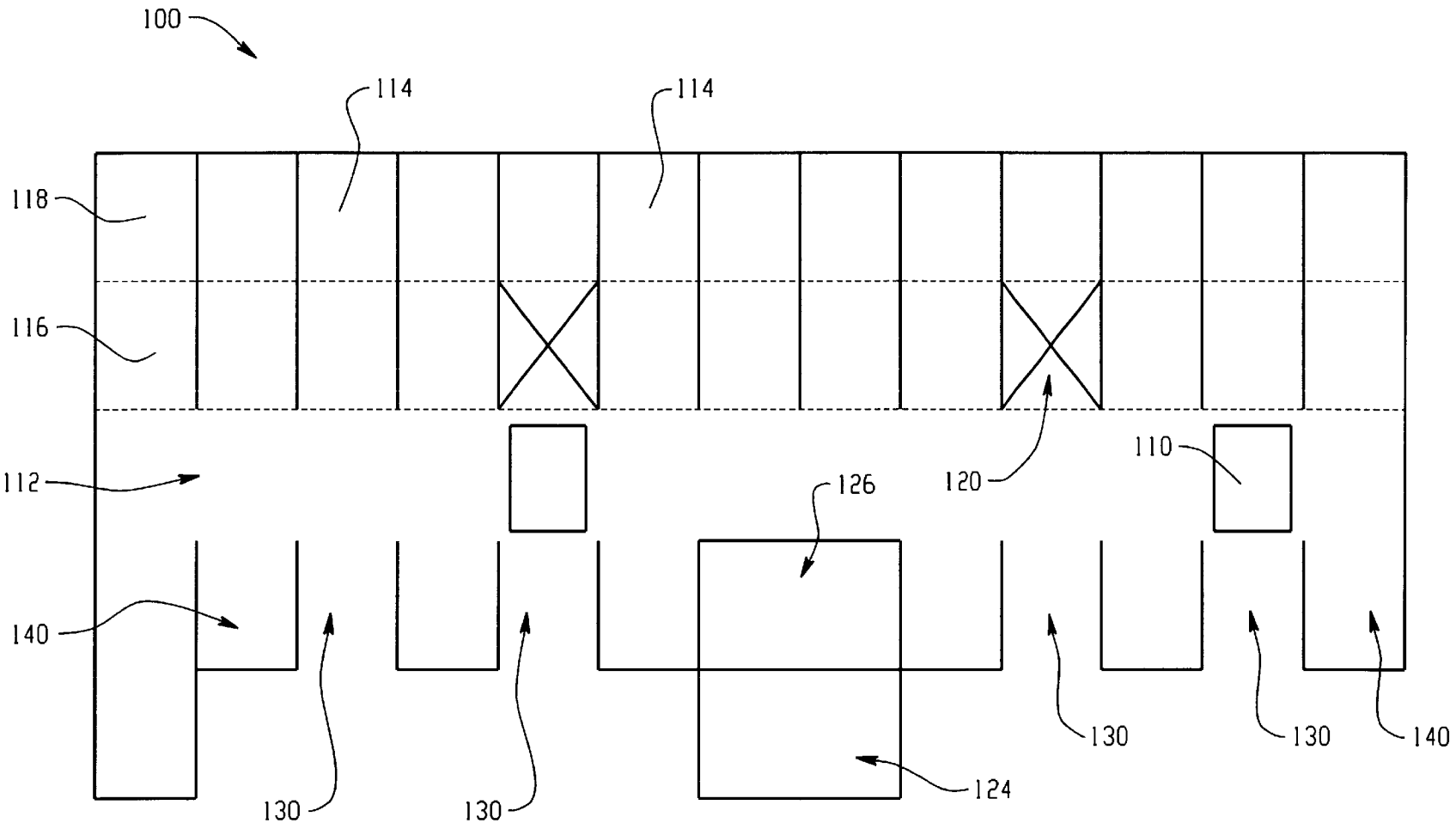
FIG. 1 is a plan view of an entry floor of an automated parking garage employing the present invention.

Referring now to the drawings, FIG. 1 is an isometric representation that shows an entry floor of an automated parking garage 100 which incorporates the method and apparatus for monitoring and controlling an automated parking system using a graphical interface according to the present invention. As shown, automated parking garage 100 includes four (4) entry/exit stations ("EES") 130. Each entry/exit station 130 is for receiving and releasing vehicles stored in the automated parking garage. Several pallet stacking stations 140 are located near the entry/exit stations 130. Of course, more or fewer entry/exit stations 130 may be employed depending on the actual and projected throughput of the garage 100. The pallet stacking stations 140 store empty pallets which are used for handling vehicles during storage and retrieval operations. A pallet is removed from a pallet stacking station 140 and distributed to an entry/exit station 130 as necessary to accommodate incoming vehicles. A pallet is removed from an entry/exit station 130 and stored in a pallet stacking station 140 as necessary to accommodate outgoing vehicles. Pallets are transported between exit/entry stations 130 and pallet stacking stations 140 using a pallet shuttle (not shown) in a manner described in U.S. patent application Ser. No. 09/364,934, the contents of which are herein incorporated by reference.

The automated parking garage 100 includes a number of storage slots 114 for storing vehicles. As shown, each storage slot 114 may store up to two vehicles. A first vehicle may be stored in an interior rack 116 and a second vehicle may be stored in an exterior rack 118. In addition to the storage available for vehicles shown in FIG. 1, storage for vehicles may be provided on upper and/or lower floors of the automated parking garage 100. Vertical lift conveyors 120 are provided for transporting vehicles between floors of the automated parking garage 100.

During storage and retrieval operations, a vehicle is transported on a supporting pallet between a storage slot 114 and an entry/exit station 130 using carrier module 110. Carrier module 110 accomplishes such transportation via aisle 112. Carrier module 110 includes a rack entry module (not shown) for transferring a pallet carrying a vehicle between the carrier module 110 and a storage rack 116 or 118, an entry/exit station 130 or a vertical left conveyor 120.

The facilities of automated parking garage 100, including, for example, vertical lift conveyor 120, carrier module 110, rack entry module (not shown) and interior and exterior doors to entry/exit stations 130 are controlled by a central computer. The central computer, executing the appropriate system software, is preferably housed in control room 126. The central computer includes a monitor and input device and is used by an operator to monitor and control the operations of automated parking garage 100. Automated parking garage 100 further includes a lobby 124 where customers may wait for their vehicles to be retrieved and pay for the automated parking service.

Vehicle Storage and Retrieval

When a vehicle enters automated parking garage 100, the vehicle enters entry/exit station 130 through an open exterior door and moves on to a pallet. Before the vehicle enters entry/exit station 130, an interior door is closed to prevent the vehicle occupants from accessing the interior of the automated parking garage 100. The driver and passengers of the vehicle exit the vehicle and the EES, and activate the automated parking system, thereby causing the exterior door to close. Carrier module 110 moves along aisle 112 to a position corresponding to the entry/exit station 130 through which the vehicle entered the garage. A rack entry module of carrier module 110 removes the pallet from the entry/exit station 130 and places it on the carrier module 110. The central computer determines an empty rack in which to store the vehicle and supporting pallet. The central computer directs carrier module 110 to traverse aisle 112 to a position corresponding to the predetermined empty rack.

In the event that the predetermined rack is located on a different floor of the garage, carrier module 110 may position itself across from a vertical lift conveyor 120, and cause rack entry module to transfer the pallet and vehicle to the vertical lift conveyor 120. Vertical lift conveyor 120 transports the pallet and vehicle to the appropriate floor of the automated parking garage where they are transferred to another carrier module 110. Once the carrier module 110 carrying the pallet and vehicle is in a position corresponding to the predetermined rack, the rack entry module transfers the pallet and vehicle to the predetermined rack for storage. One of ordinary skill will understand that similar steps may be executed when retrieving a vehicle from storage.

The operation of garage 100 is monitored and controlled by a central computer executing a garage control application. FIGS. 2–7 illustrate various windows and displays employed by the garage control application to enable an operator to monitor and control the operation of the automated parking system.

Main Control Window

Figure 2A:
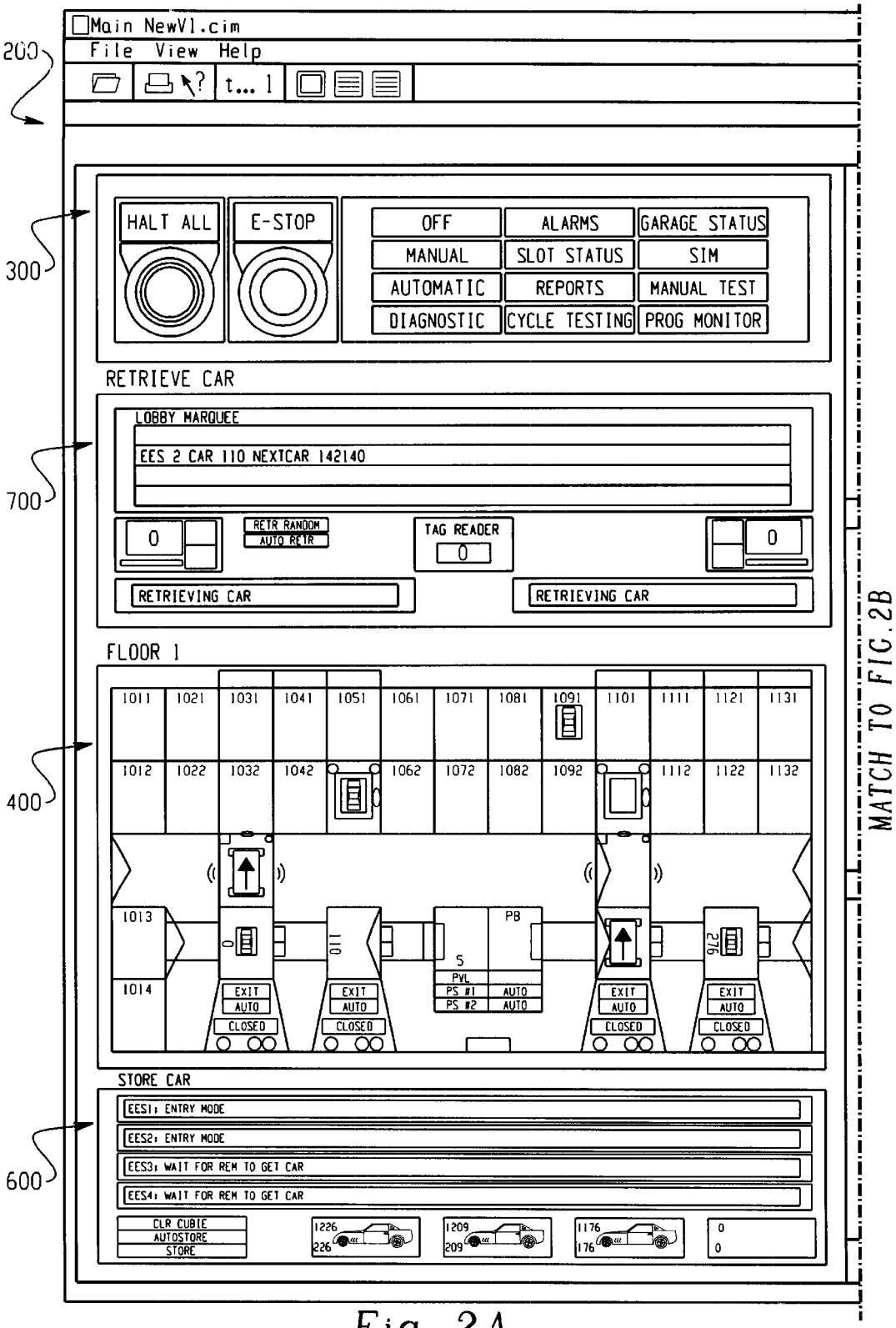
FIG. 2 is a computer screen display of a main control window displayed by a computer controlling the operation of the automated parking garage of FIG. 1.
Figure 2B:
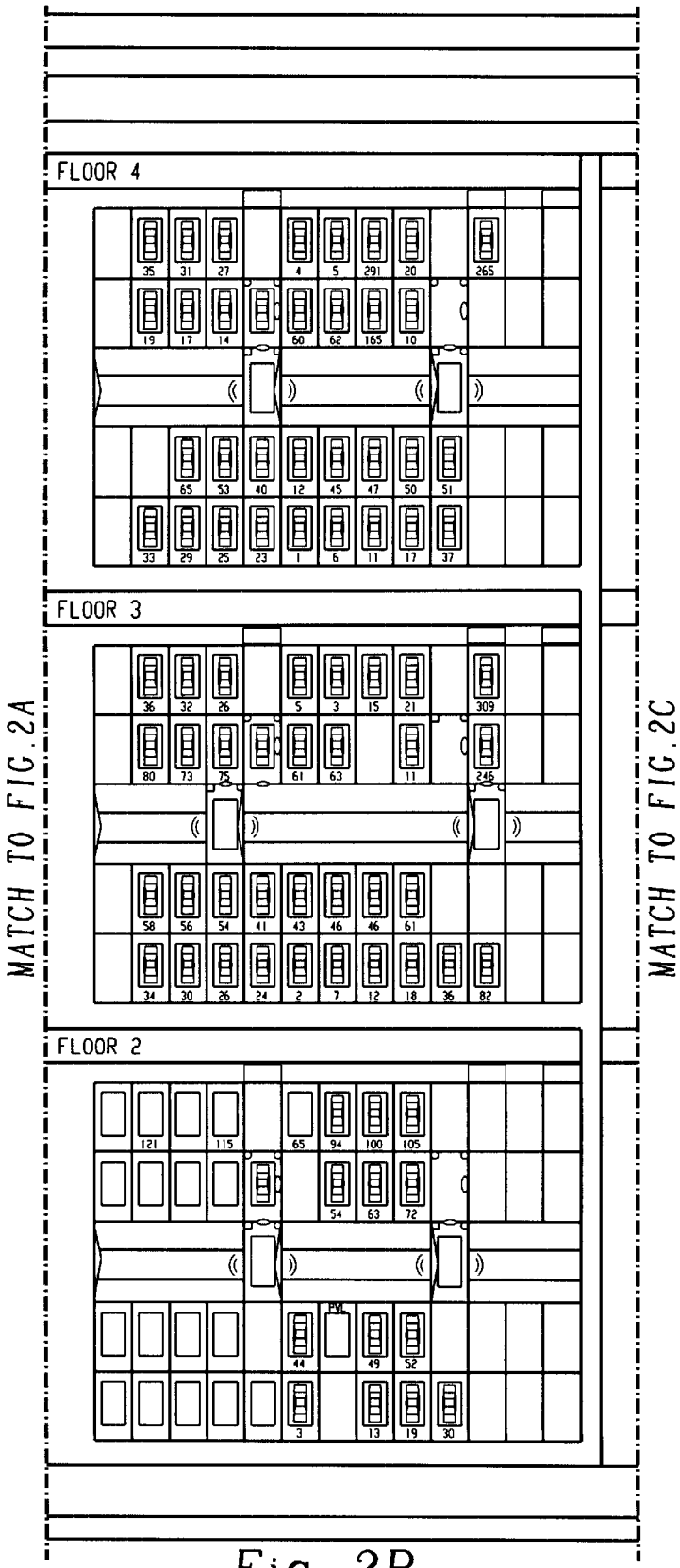
Figure 2C:
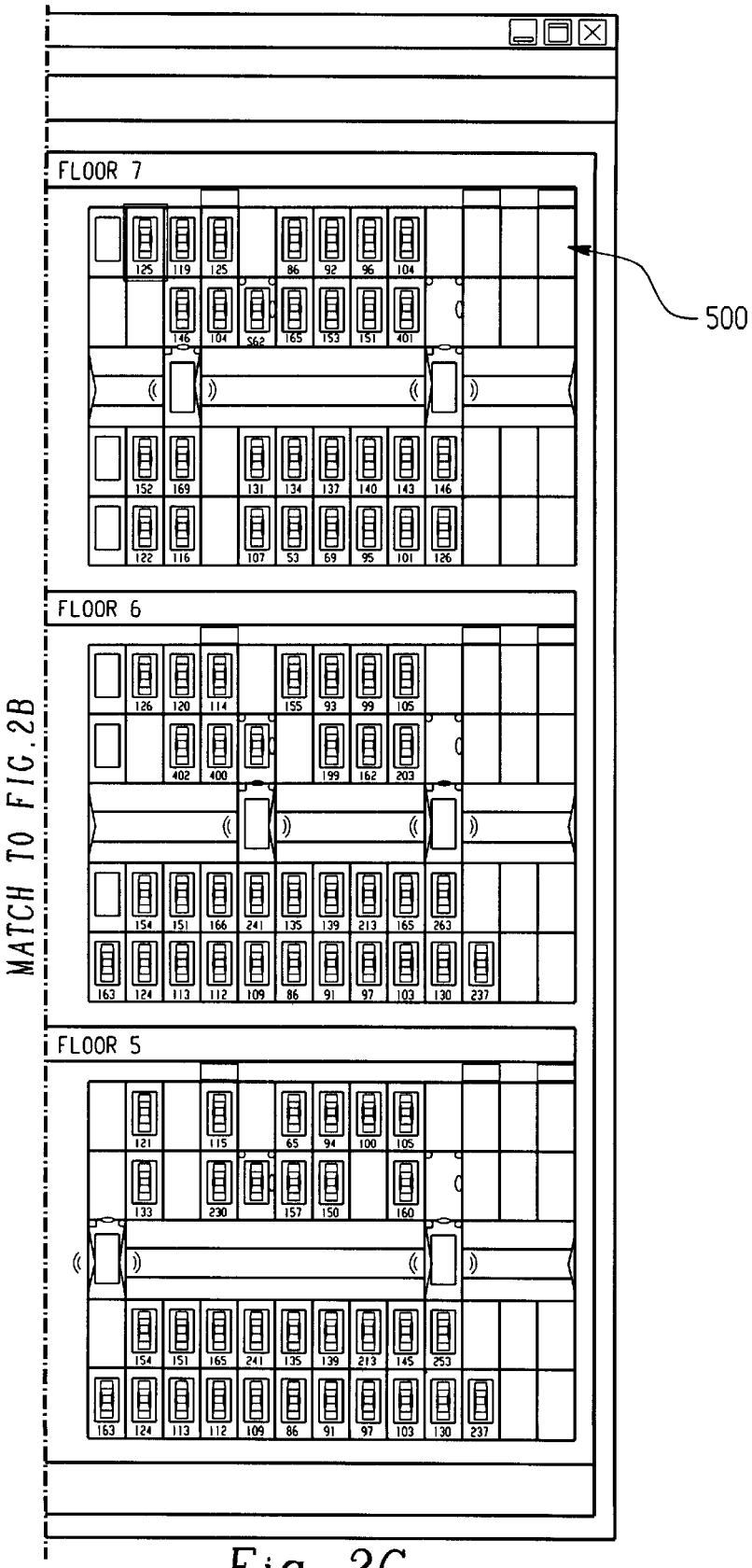

FIG. 2 is a computer screen display of a main control window 200 which is displayed by the central computer controlling the operation of automated parking garage 100. The main control window includes a global control panel portion 300 including objects for monitoring and controlling the overall operation of automated parking garage 100, a store car panel portion 600 for controlling the storage of vehicles within automated parking garage 100, and a retrieve car panel portion 700 for controlling the retrieval of vehicles from automated parking garage 100. The main control window 200 further includes graphical representations of each of the floors of automated parking garage 100. The entrance level display area 400 represents the physical components and status of the first floor through which vehicles may enter and exit the garage. The contents and status of the other floors are similarly displayed. One example of such a display is the seventh floor display area 500.

Global Control Panel

Figure 3:
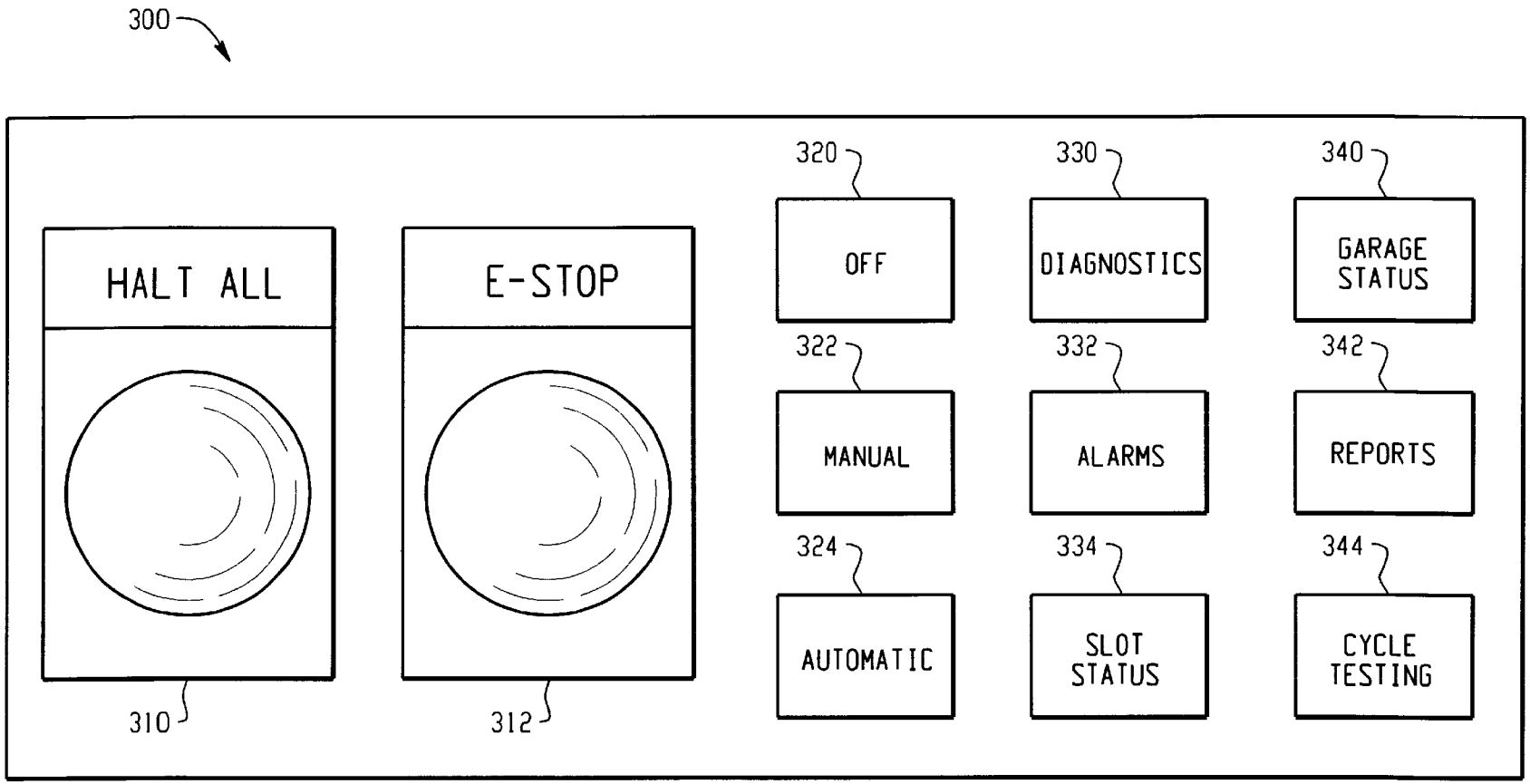
FIG. 3 is a computer screen display of the global control panel of the main control window of FIG. 2.

Referring now to FIG. 3, there is depicted the global control panel ("GCP") portion 300 of the main control window 130. The global control panel contains objects that report the status of automated parking garage 100 and allows an operator to control the garage as a whole.

On the left hand side of GCP 300, there are illustrated controls, "Halt All" and "E-Stop", for stopping the operation of the components of the automated parking garage 100. The "Halt All" button 310 enables the operator to direct the control program to refrain from sending any commands to the components of automated parking garage 100. While no new commands will be sent, all current commands are processed until completion. Button 310 is particularly useful to shut down the garage, for example, for equipment inspection and maintenance. "E-Stop" button 312 enables the operator to direct the control program to send a command that immediately stops the motion of every component of the garage. Button 312 is particularly useful in emergency situations requiring a "system hard stop".

Along the right side of GCP 300, there are three columns of buttons which enable the operator to control and/or monitor the operation of garage 100. The operator may select "Off" button 320 to take the garage offline, effectively disabling down all aspects of the garage from software control. "Manual" button 322 enables the operator to direct the control of all components of the parking garage through software controls. "Automatic" button 324 enables the operator to place the control software in an automatic mode, thereby directing that the components of the garage be controlled according to pre-programmed parameters. "Diagnostics" button 326 enables the operator receive a display of diagnostic information related to various components of the garage.

Operator selection of the "Alarms" button 330 causes an alarm management window to be opened. The alarm management window enables the operator to review and control the status of all alarms associated with the garage. When an alarm is generated, "Alarms" button 330 is highlighted and an audible warning is presented.

"Slot Status" button 332 opens a window enabling the operator to review the status of any requested slot within the garage. The "Reports" button 334 allows the operator to display and print reports regarding the operation of the garage. Selecting the "Cycle Testing" button 336 causes a window showing the cycle testing modules to be opened, thereby enabling the operator to test the cycles of certain hardware used in the operation of the garage. Operator selection of the "Garage Status" button 340 causes a window to be displayed showing the current vehicle inventory and the queued store and retrieve commands.

First Floor Representation

Referring now to FIG. 4, a more detailed view of the first floor display area 400 of the main control window of FIG. 2 is shown. As shown, first floor display area 400 includes not only objects representing actual physical components of the garage 100, but also the status of certain components, and the contents of garage 100.

The interior racks 116 and exterior racks 118 of storage slots 114 are all represented in the display, with each rack being assigned a unique identification number. By way of example, interior rack 416 has been assigned an identification number of "1012", and exterior rack 418 has been assigned an identification number of "1011". The identification numbers may be assigned in any number of ways, but in the present example, the identification number of each slot is based on the floor, aisle position and row of each slot. Interior rack slot 416 is on the first floor, represented by the first digit "1". It is in the first aisle position represented by the next two digits "01", and it is in the second row, represented by the fourth digit "2".

The contents of each slot is further represented in display area 400. For example, exterior rack slot 418 is empty. As further examples, slot 417 contains a stack of pallets, and slot 419 contains a vehicle stored on a pallet. Every vehicle handled by the garage is assigned a unique vehicle identification number which is displayed below the vehicle icon in the storage slot.

In manual operation, an operator may select an occupied slot, such as slot 419, to command the control program to retrieve a car. In that case, the selected slot is preferably highlighted to indicate that the stored vehicle is queued for retrieval. Likewise, an operator selection of an empty slot is interpreted as a command to store a car in the selected slot. When a stored vehicle is requested, the slot is highlighted to indicate that the slot is reserved for vehicle storage.

Figure 4A:
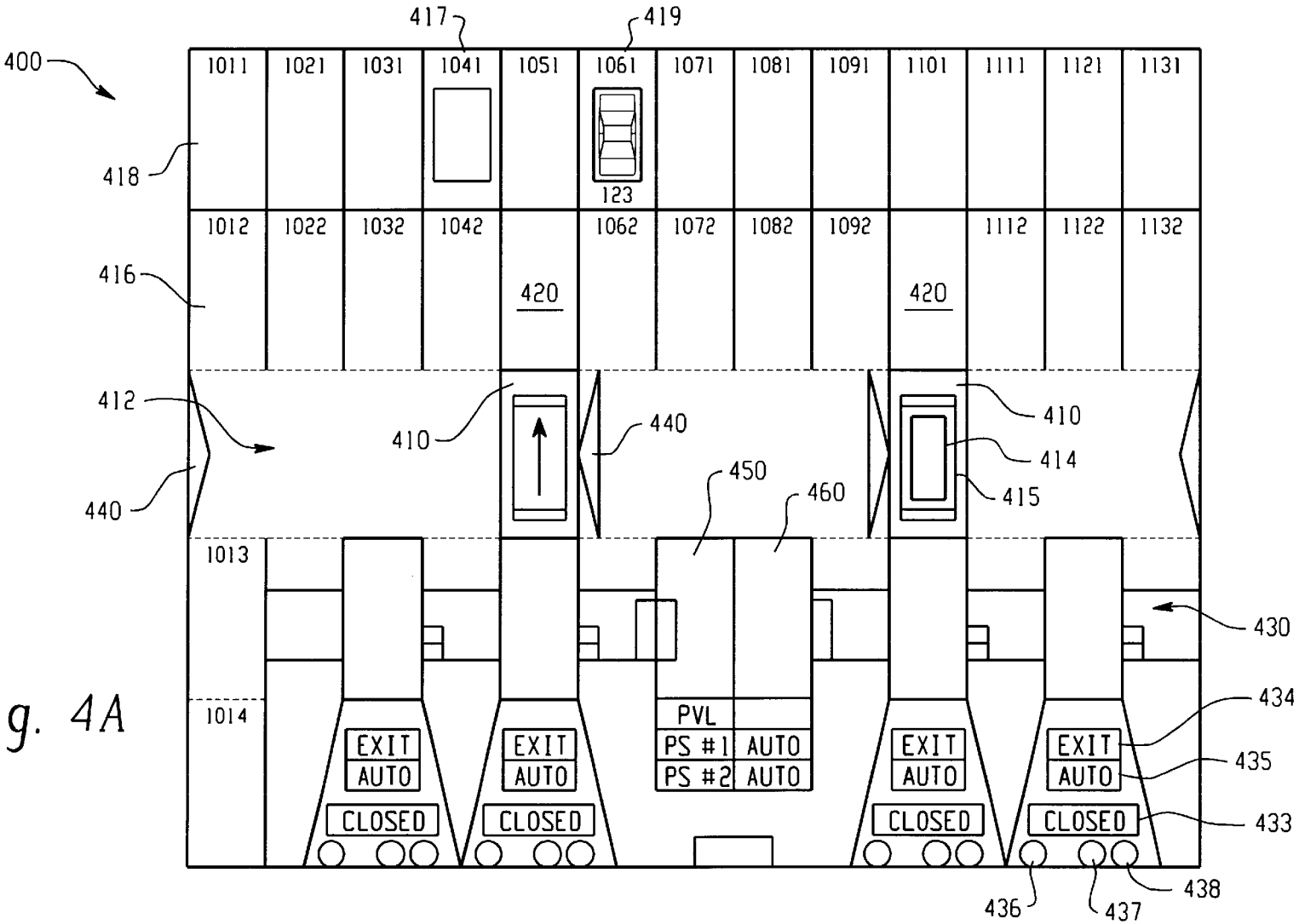
FIG. 4 is a computer screen display of the first floor display area of the main control window of FIG. 2.
Figure 4B:
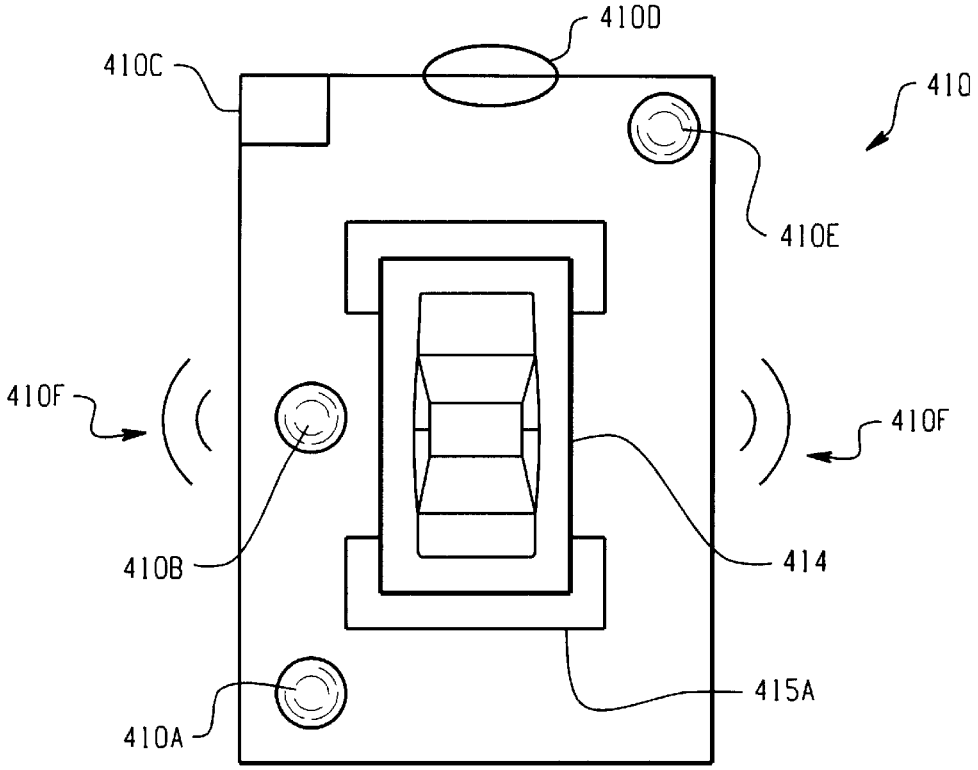

Like the physical garage, display area 400 includes an aisle display 412 along which carrier module objects 410 traverse. The display area 400 also displays the physical status and contents of carrier modules through each carrier module object 410. Referring now to FIG. 4B, there is illustrated a more detailed view of carrier module object 410. Each carrier module object 410 includes an E-Stop indicator 410A denoting whether an emergency stop request has affected the carrier module. Home indicator 410B indicates whether the carrier module is in the home position. A carrier module unit number 410C is displayed in the upper left corner to identify the carrier module associated with carrier module object 410. VLC detector status, namely whether a VLC has been detected, is depicted at 410D. In the upper right hand corner, an "Auto-ready" indicator 410E indicates whether the associated carrier module is ready or in-use when the control program is in "Automatic" mode. Sensor indicators 410F indicate that motion sensors are operating to detect movement as a safety precaution.

The background color of carrier module 410 may be used to indicate whether the garage is operating in automatic or manual modes. In manual mode, selecting carrier module object 410 identifies the operator's intention to move the carrier module. Subsequent selection of a slot causes a TRAVEL, GET or PUT command, based on the circumstances. When carrier module is traveling, limit markers 440, shown in FIG. 4A, are used to indicate the range of motion. In manual mode, limit markers 440 may be dragged by an operator to limit the working area of a carrier module.

Figure 4C:
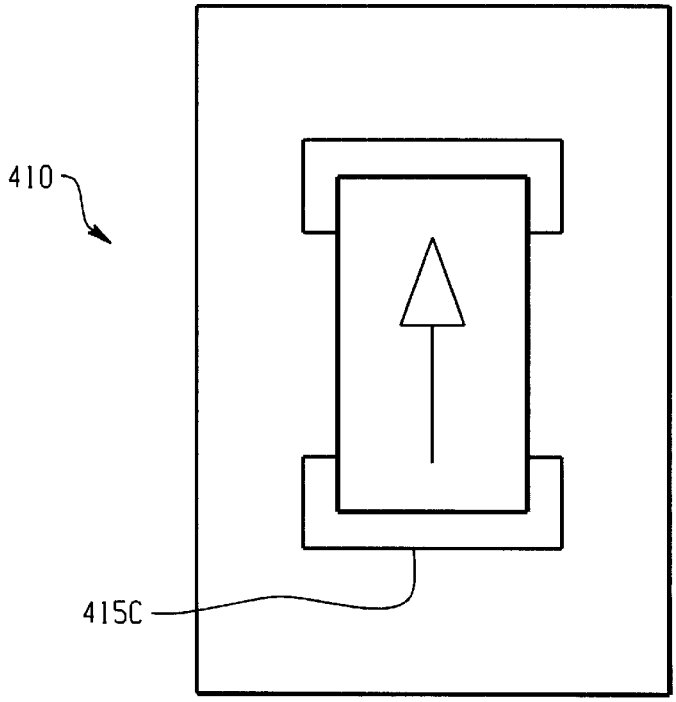
Figure 4D:
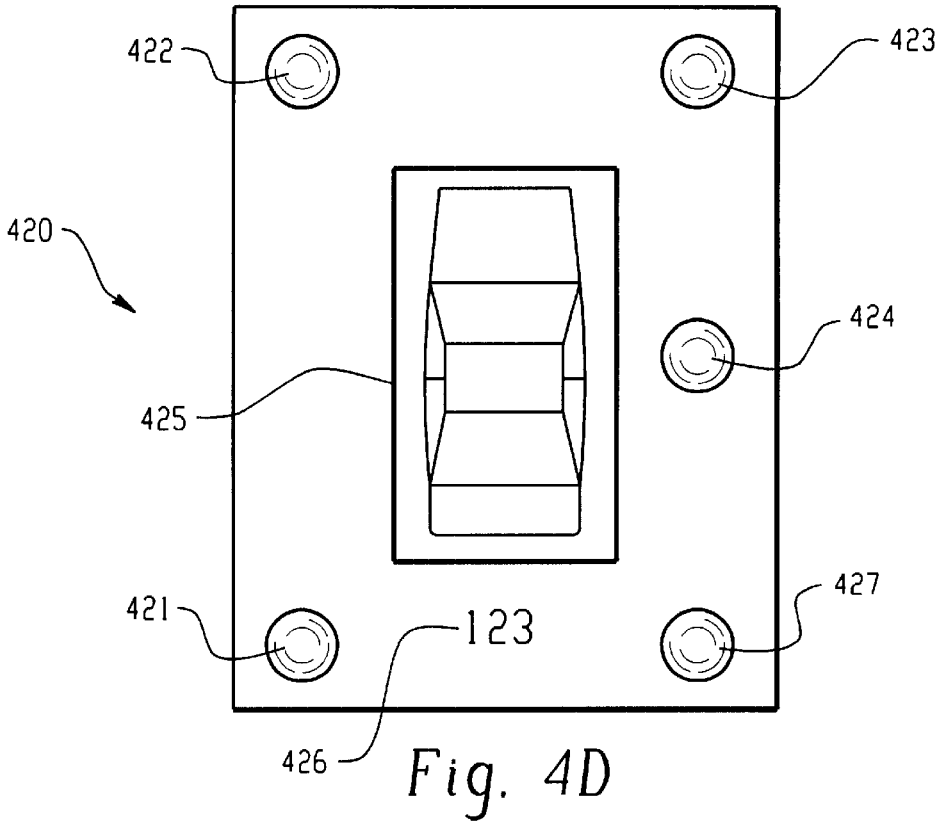

The contents of a carrier module and the status of an associated rack entry module is depicted at 415. In FIG. 4B, rack entry module object 415B, containing a vehicle on a pallet, is illustrated. In FIG. 4C, rack entry module object 415C is illustrated without a pallet or vehicle. The arrow indicates the access direction of the rack entry module Referring back to FIG. 4A, display area 400 also includes objects representing vertical lift conveyor s 420 and objects representing Entry/Exit Stations 430. More detailed views of vertical lift conveyor representations are illustrated in FIG. 4D. Each vertical lift conveyor icon 420 may include an E-Stop indicator 421 to indicate whether the conveyor has been affected by an E-Stop request. Vertical lift conveyor icon 420 may also include a unit number 422 to identify the VLC, an auto-ready indicator 423 to indicate that the unit is ready when the garage is in Automatic mode, a "REM In" indicator to indicate when a rack entry module is obstructing vertical movement of the VLC. When appropriate, a vertical lift conveyor icon 420 may include a car and/or pallet representation 425. If a car is present, the vehicle identification number will be displayed at 426.

Each vertical life conveyor may be depicted by multiple icons 420, with the vertical lift conveyor being represented at each floor. Vertical life conveyor icon 420 includes a command button 424 that allows an operator to manually request a vertical lift conveyor to move to a specific floor when the garage is operating in a manual mode. For example, a user wishing to command a vertical life conveyor to move to the first floor may select button 424 of the vertical lift conveyor icon 420 displayed on the first floor display area 400.

Figure 4E:
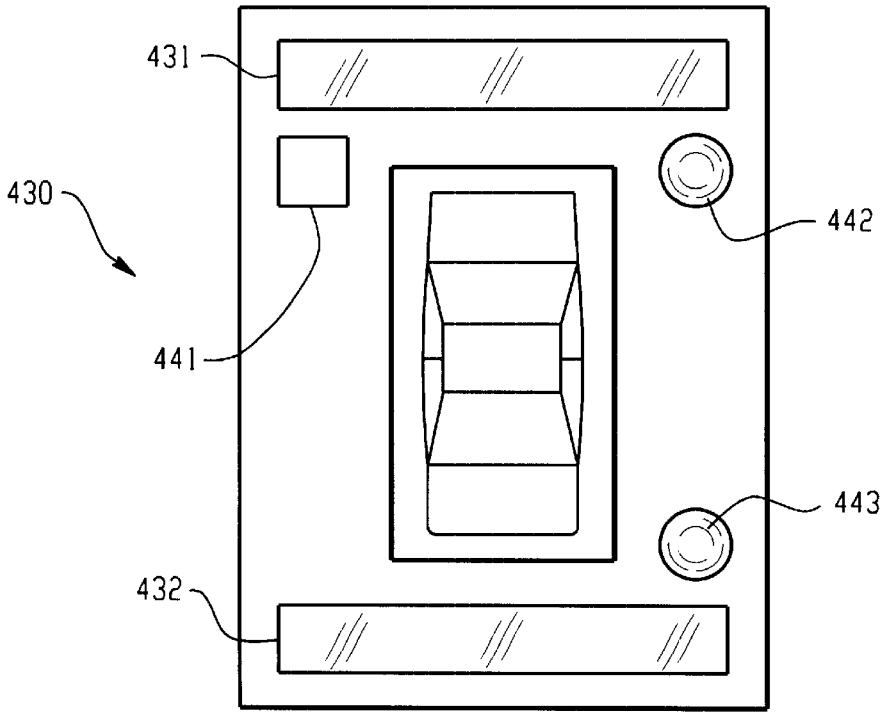

The Entry/Exit Stations are depicted as a group of objects 430, including several objects that identify the status of the Entry/Exit Station 430. When the garage is operating in automatic mode, the background is yellow, and when the garage is opoerating in manual mode, the background is red. FIG. 4E provides a more detailed view of an Entry/Exit Station 430. Each EES includes an interior and exterior door. The status of interior and exterior EES doors are depicted at 431 and 432, respectively. When a door is closed, the associated door object 431 or 432 is presented in green. When a door is open the associated door object 431 or 432 is presented in red, and when a door is in between, the associated door object 431 or 432 is presented in yellow. Operator selection of a door object causes the control program to send an OPEN or CLOSE command, as appropriate.

Each EES has an assigned unit number depicted at 441. Each EES includes an "REM-in" indicator 442 indicating whether a rack entry module is presently in the EES, and a "PS-in" indicator 443 indicating whether a pallet shuttle is in the EES. Of course, a vehicle and pallet may be displayed, as appropriate, to indicate the presence of a vehicle and/or a pallet.

Referring back to FIG. 4A, the garage door is shown on the first floor display area at reference numeral 433. Like door indicators 431 and 432, door indicator 433 may be depicted as having a status of open, closed or in between. At reference numeral 434, the traffic flow of each EES is also controlled and depicted. Each EES may be programmed to receive or release vehicles, and are depicted as having "enter" or "exit" traffic flow, respectively. Further, each EES may be individually programmed to operate automatically or manually, and the relevant status is controlled and via object 435 as either "auto" or "manual", respectively.

It should be noted that each EES includes equipment for measuring the length, width and height of each vehicle intering the garage to determine whether the vehicle can be accomodated. Each EES is further equipped with a message center instructing and alerting the driver through visual and auditory cues. In addition certain parts of the garage are outfitted with motion/live body detectors to avoid injury.

Each EES 130 of the physical garage also preferably includes three standard traffic indicators. Objects representing each of these indicators are also included in the depiction of EES on display area 400. Indicators 436, 437 and 438 are red, yellow and green indicators, respectively.

Figure 4F:
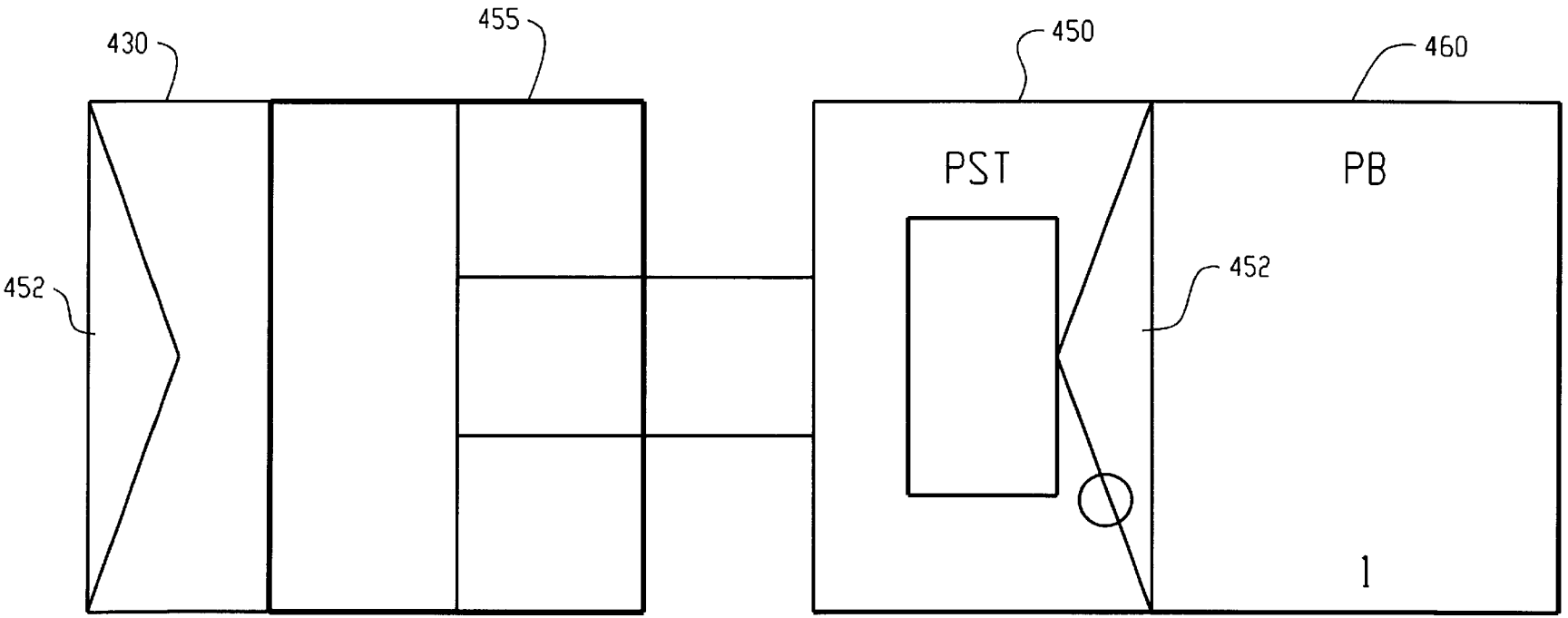

As described in U.S. application Ser. No. 09/364,934, the garage includes hardware for buffering pallets, and performs a method of buffering them using the hardware. Among other garage operations, the operation of the pallet buffering method is also depicted by the graphical user interface of the present invention. FIG. 4F shows the graphical representations of the pallet stacking and delivery components of garage 100.

The display includes a pallet stack object 450, a pallet buffer object 460, and a pallet shuttle object 455. The pallet shuttle object 455 moves between the pallet stack 450, pallet buffer 460 and EES 430 to manage the supply of pallets according to the pallet stacking and delivery method employed at garage 100. Pallet shuttle limit markers 452 indicate the range of motion of pallet shuttle object 455 for the current command.

Representations of Other Floors

Figure 5:
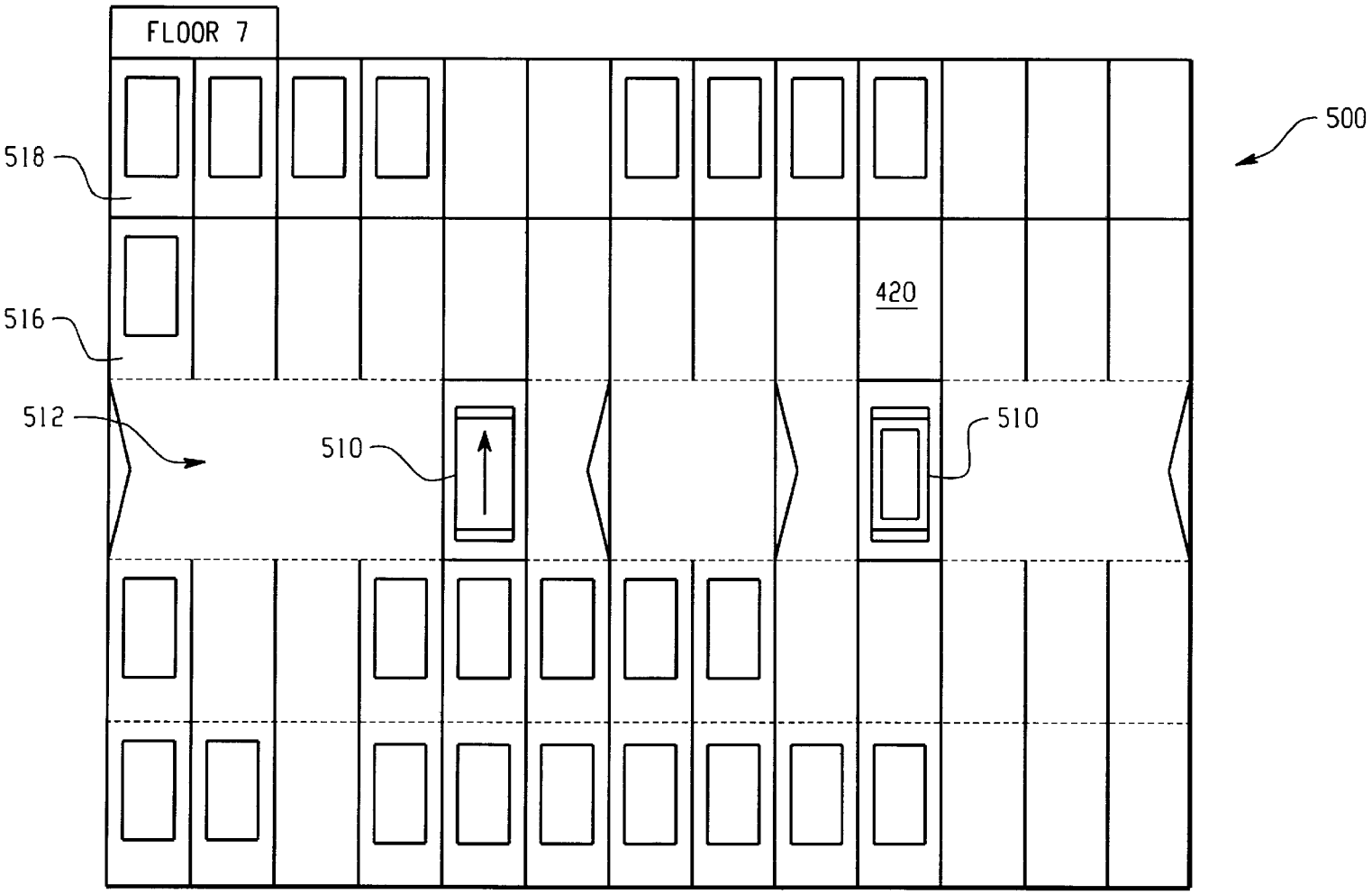
FIG. 5 is a computer screen display of the seventh floor display area of the main control window of FIG. 2.

Every floor of the garage may be represented by the garage control application. According to the preferred embodiment, every floor of the garage is represented in the main control window, as shown in FIG. 2, although secondary windows could be used in the event the parking garage was too large to be conveniently depicted in a single window. Referring now to FIG. 5, a more detailed view of the seventh floor display area 500 of the main control window of FIG. 2 is shown. The seventh floor display area 500 is includes many of the same elements as first floor display area 400, except that it does not include objects related to any EES 120. Unlike the first floor, the seventh floor of garage 100 does not have direct access to any area outside of the garage.

As shown, the seventh floor display area includes objects representing an aisle 512, two carrier modules 510 capable of traversing the aisle, a number of storage slots including interior racks 516 and exterior racks 518, and access to two vertical lift conveyors 420. In addition, the seventh floor display area includes objects representing the status and contents of the seventh floor of garage 100.

Store Car Panel

Figure 6:
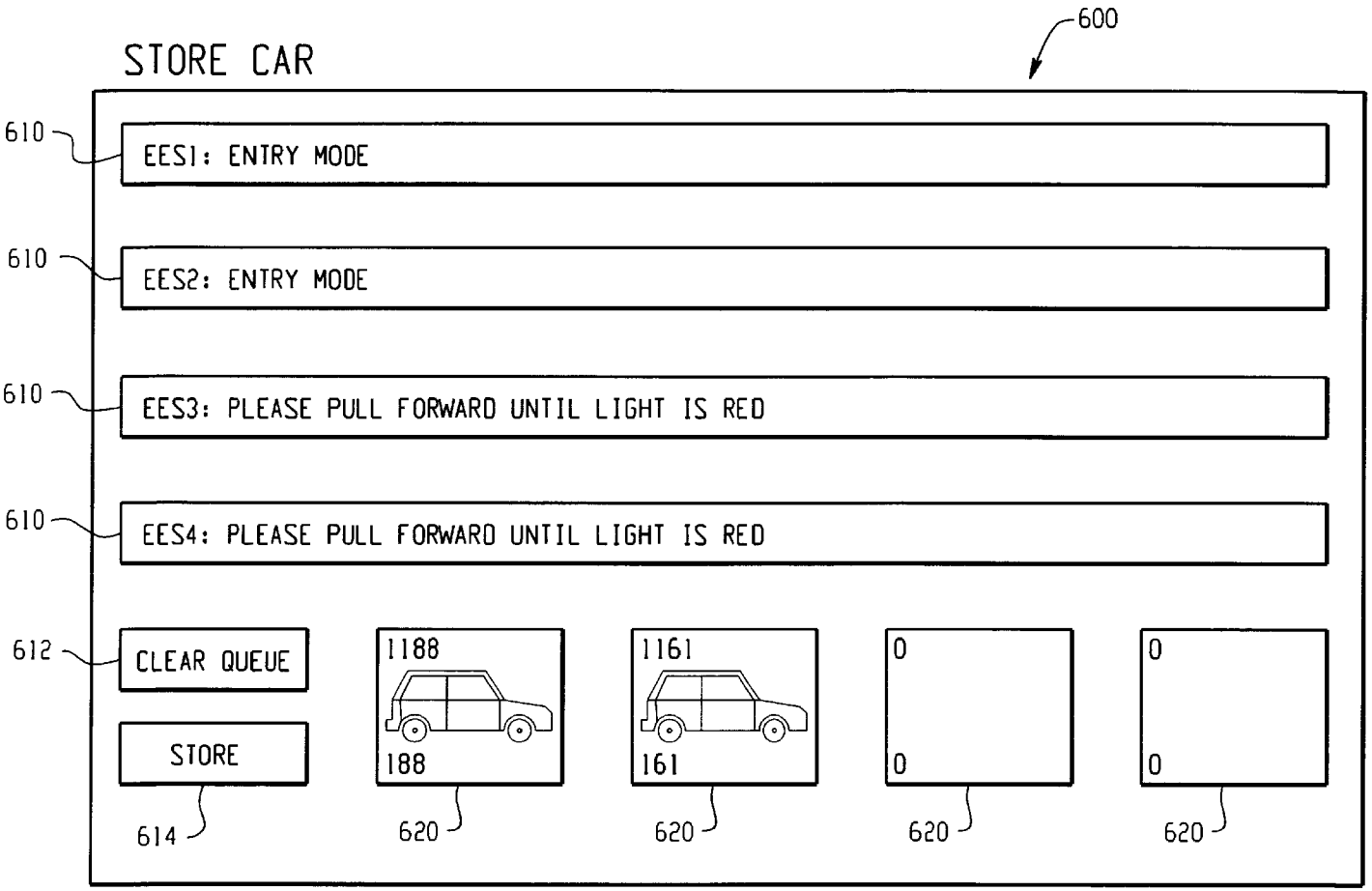
FIG. 6 is a computer screen display of the Store Car panel of the main control window of FIG. 2.

Referring now to FIG. 6, there is illustrated a more detailed view of Store Car panel portion 600. Store Car panel 600 includes four indicators 610 which monitor the contents of the marquee for each of the four Entry/Exit Stations. Each marquee is part of a message center to provide instructions to a driver of a vehicle to be stored. Message center includes an interface between the driver and the control program. The interface utilizes feedback from various sensors including, for example, video cameras, motion sensors and measuring devices. The sensor outputs are received and analyzed by the control program which determines and provides instructions to a driver via messages displayed on the marquee. Clear Queue button 612 enables an operator to clear the displayed queue of cars waiting in the store queue outside the garage.

Store Car panel 600 further includes four queue objects 620. Each object represents a car in the queue of cars awaiting storage. The anticipated slot identification is displayed in the upper left corner of each object 620, and the vehicle identifier is displayed in the lower left corner of each object 620.

Retrieve Car Panel

Figure 7:
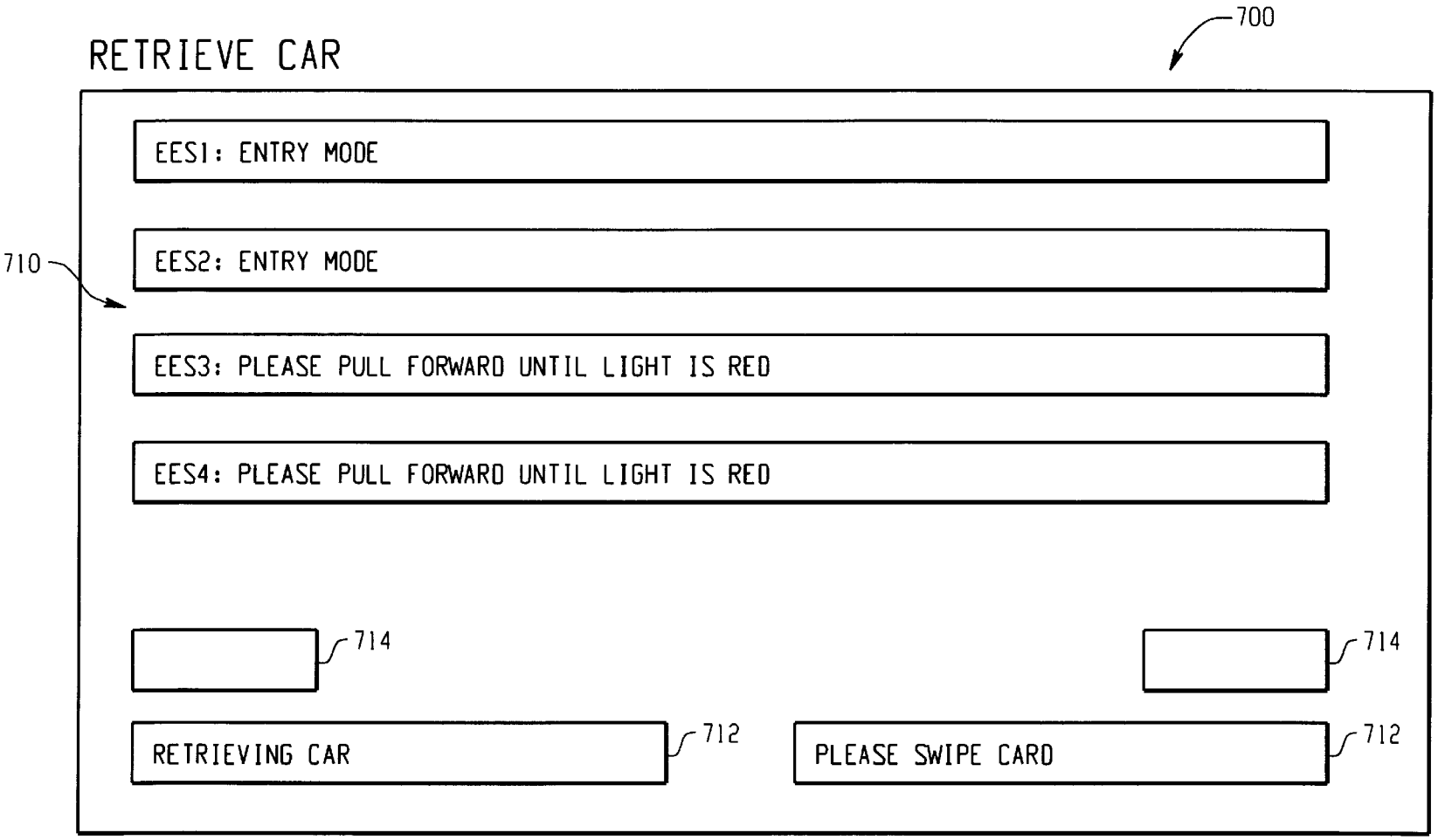
FIG. 7 is a computer screen display of the Retrieve Car panel of the main control window of FIG. 2.

Referring now to FIG. 7, there is illustrated a more detailed view of Retrieve Car panel portion 700. Retrieve Car panel 700 includes a four line indicators 710 which monitors the contents of the lobby marquee. As with storing a vehicle, the control program interfaces with a driver requesting a vehicle. Display areas 712 monitor the status messages displayed to a user requesting retrieval of a vehicle. Each display area 712 is associated with a keyboard 714. Operator selection of keyboard 714 opens a window allowing a request for a vehicle to be input.

Main Diagnostic Window

Figure 8:
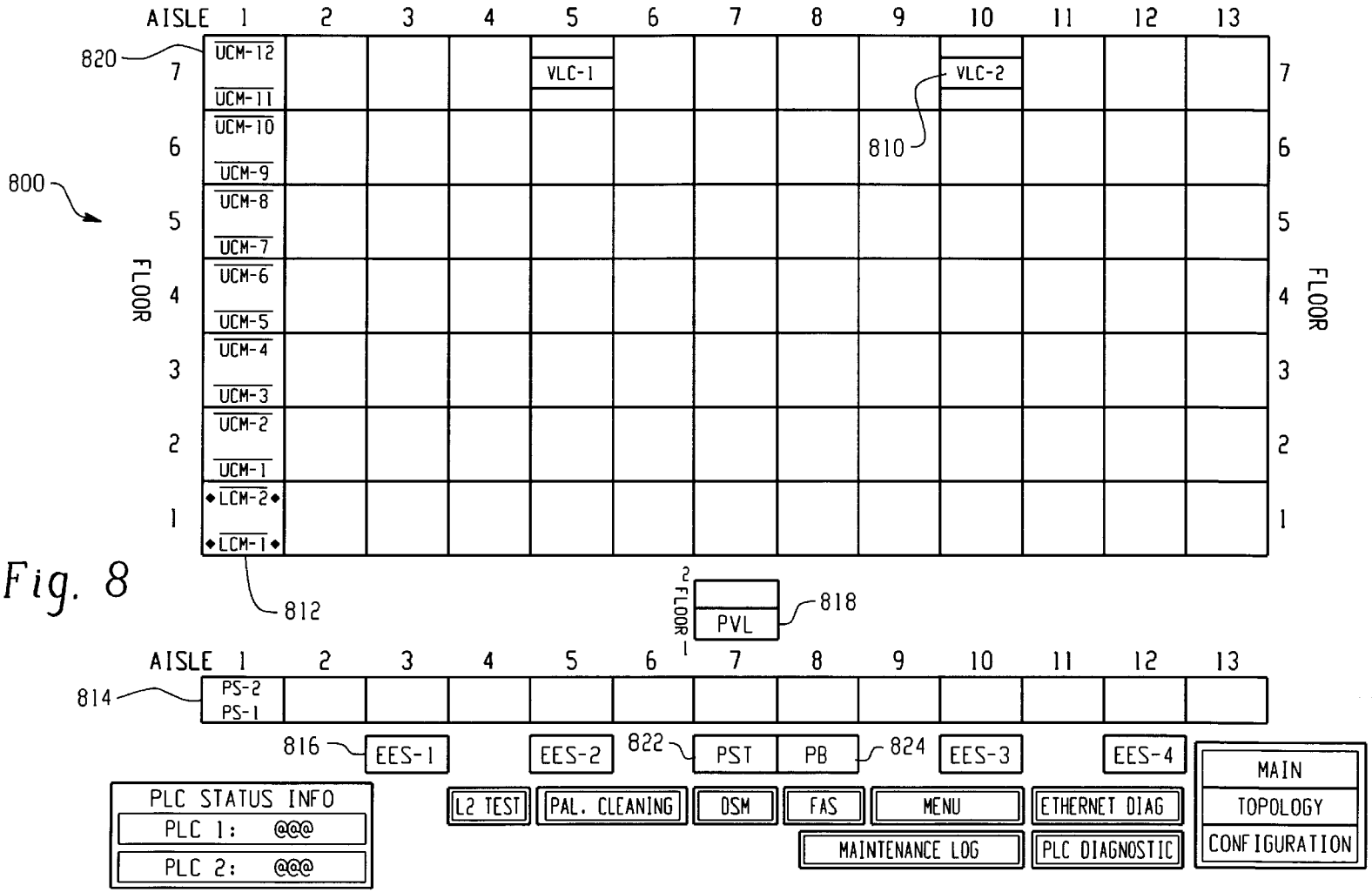
FIG. 8 is a computer screen display of a main diagnostic window displayed by a computer controlling the operation of the automated parking garage of FIG. 1.

Referring now to FIG. 8, there is illustrated the Main Diagnostic Screen 800 that is displayed upon an operator selection of the Diagnostics button 330 from the global control panel 300, shown in FIGS. 2 and 3. Main Diagnostic Screen 800 enables the operator to review the overall configuration of the garage, and received more detailed diagnostic information regarding specific selectable components.

The major portion of the screen is arranged to simulate a cross section of the garage, with floors being represented along the Y-axis and aisles or rows represented along the X-axis. As an example, at reference numeral 810, vertical lift conveyor 2 is shown on the seventh floor in aisle 10. The major components of the garage are depicted, for example, at reference numeral 812, lower carrier module 1 is shown in aisle 1 of floor 1. Upper carrier module 12, as indicated by reference numeral 820, is shown in aisle 1 of floor 7.

In the lower portion of Main Diagnostic Screen 800, the pallet delivery equipment is depicted. For example, at reference numeral 814, pallet shuttle 1 is shown under aisle 1. At reference numeral 818, the pallet vertical lift is shown on the first floor.

At the extreme bottom of the Main diagnostic Screen 800, there are buttons representing each Entry/Exit Station, such as at 816, the pallet stacker 822, the pallet buffer 824 and a number of buttons enabling an operator to run specific diagnostics on the garage. A few of the supported diagnostics include pallet cleaning, digital server module, floor/area/slot, communication diagnostics, and programmable logic controller diagnostics.

Figure 9A:
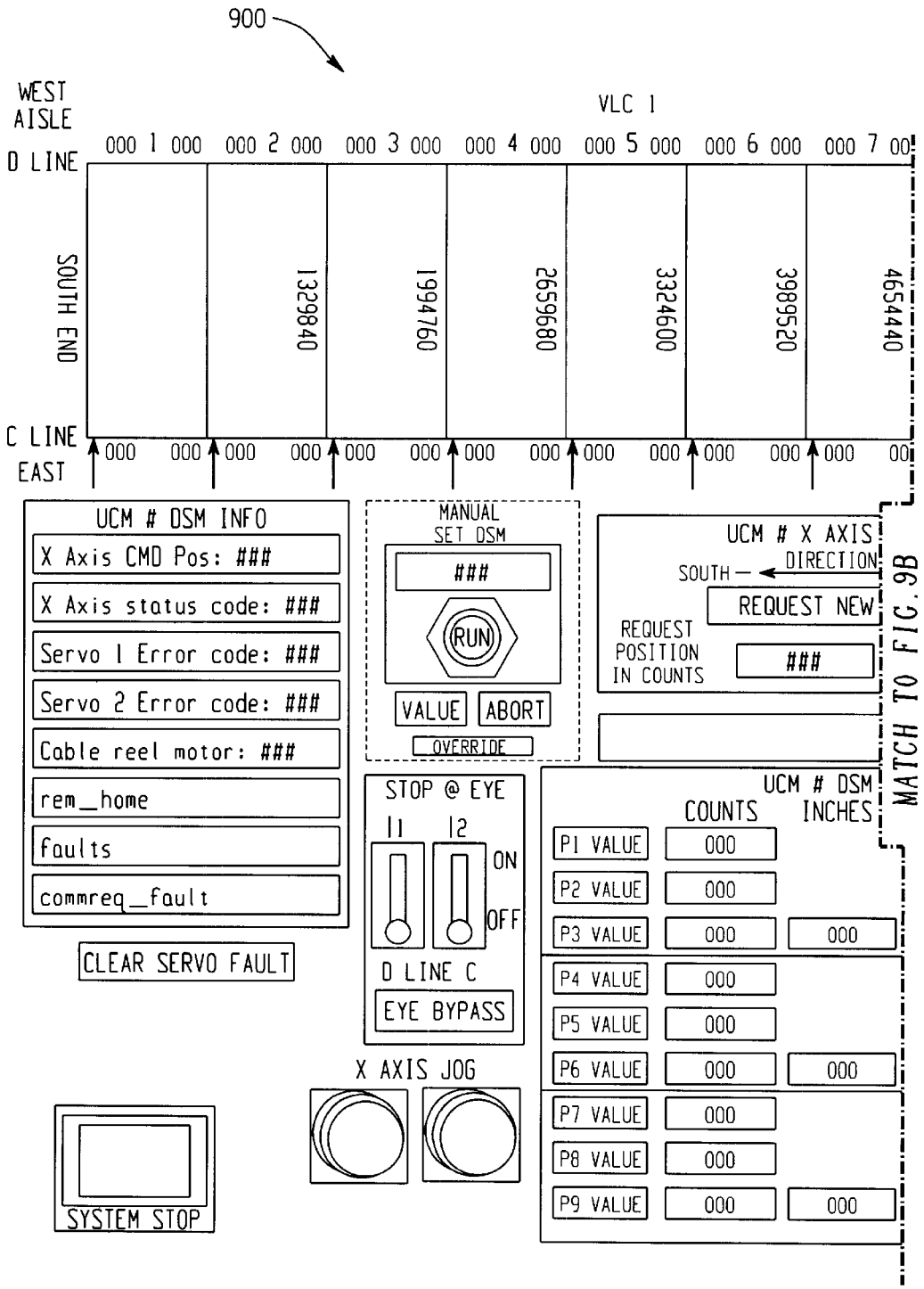
FIG. 9 is a computer screen display of an Upper Carrier Module Diagnostic window displayed by a computer controlling the operation of the automated parking garage of FIG. 1.
Figure 9B:
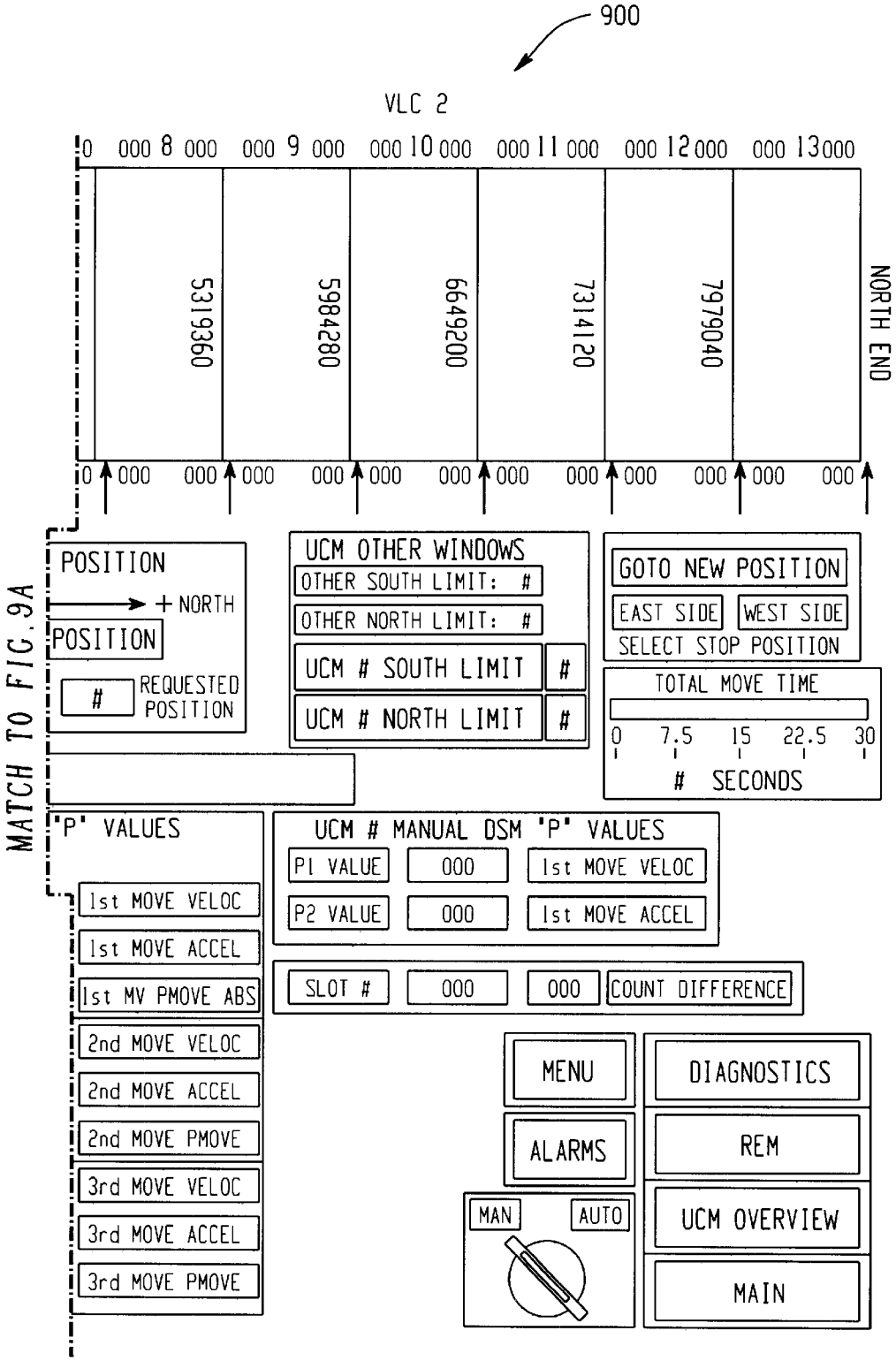

Each element of the garage displayed on Main Diagnostic Screen 800 may be selected for further information. For example, operator selection of upper carrier module 12, at reference numeral 820, would cause a more detailed screen to be displayed, such as the Upper Carrier Module Diagnostic Screen illustrated in FIG. 9.

Basic Operation of Automated Parking Garage System

Figure 10:
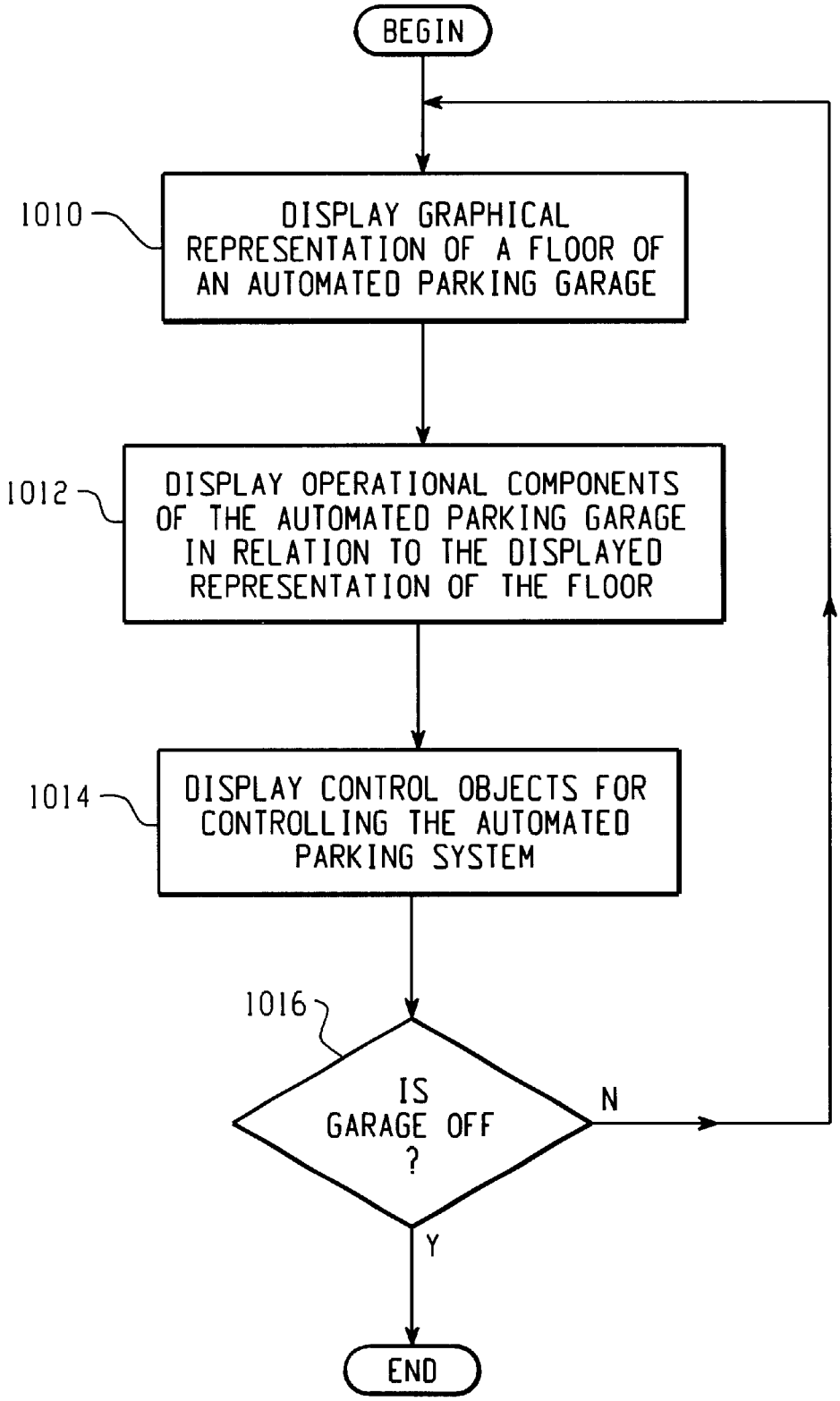
FIG. 10 is a flowchart illustrating the steps performed according to the present invention.

Referring now to FIG. 10, there is a flowchart illustrating the basic operation of the automated parking garage system. At step 1010, the garage control application causes the computer to display a graphical representation of a floor of the automated parking garage. In the preferred embodiment, every floor of the automated parking garage is displayed.

At step 1012, the operational components of the automated parking garage are displayed in relation to the displayed representation of the floor. The operation components of the automated parking garage include the entry/exit stations, the carrier modules, the rack entry modules, the storage racks, the pallet vertical lifts and the vertical lift conveyors. The display of these components provides the operator an accurate representation of the status of the floor of the automated parking garage. Of course, some of these components may also provide control elements to enable the operator to change the status of the component.

At step 1014, the garage control application displays a plurality of control objects. Each control object is associated with controlling an aspect of the automated parking system. Examples of the control objects include, for example, Manual button 322, Automatic button 324, and Halt-All button 310, described in more detail with reference to FIG. 3. By selecting an object representing a component of the automated parking garage, the operator can change the status of the component associated with the selected object. By selecting a control object, the operator can control the automated parking system according to the function associated with the selected control object. At step 1016, if the garage is still operating, the control program continues to update the display and poll for input, and program control loops back to block 1012.

Although this invention has been described in its preferred forms with a certain degree of specificity, it is understood that the present disclosure of the preferred form has been made only by way of example and numerous changes in the details of construction and combination and arrangement of parts may be resorted to without departing from the spirit and scope of the invention.

What is claimed is:

1. A method for monitoring and controlling an automated parking system using a graphical user interface, comprising:

displaying a graphical representation of a floor of an automated parking garage;

displaying a plurality of objects in relation to the floor, thereby representing the state of the floor, the plurality of objects representing an entry/exit station (EES); a module for transporting a vehicle along an x-axis, a module for transporting a vehicle along a y-axis, a module for transporting a vehicle along a z-axis, and a plurality of storage racks; and displaying a plurality of control objects, each control object associated with controlling an aspect of the automated parking system.

2. The method of claim 1, wherein the plurality of control objects includes an automatic control object, the method further comprising:

receiving a user selection of the automatic control object, representing a command to operate the automated parking system according to predefined parameters; and controlling associated physical components of the automated parking system according to the predefined parameters.

3. The method of claim 1, wherein the plurality of control objects includes a manual control object, the method further comprising:

receiving a user selection of the manual control object, representing a command to operate the automated parking system manually; and controlling associated physical components of the automated parking system according to manual instructions received from the user.

4. The method of claim 1, wherein the plurality of control objects includes a halt-all control object, the method further comprising:

receiving a user selection of the halt-all control object, representing a command to halt the operation of every component of the automated parking garage; and transmitting a signal to every component of the automated parking garage, thereby halting the operation of every component.

5. The method of claim 1, wherein the plurality of control objects includes an emergency stop control object, the method further comprising:

receiving a user selection of the emergency stop control object, representing a command to immediately stop the operation of every component of the automated parking garage; and transmitting a signal to every component of the automated parking garage, thereby immediately stopping the operation of every component.

6. The method of claim 1, wherein the plurality of control objects includes a diagnostic control object, the method further comprising:

receiving a user selection of the diagnostic control object, representing display diagnostic information related to at least one component of the automated parking garage; and displaying diagnostic information related to the at least one component of the automated parking garage.

7. The method of claim 1, wherein the plurality of control objects includes an traffic flow control object associated with an entry/exit station, the method further comprising:

receiving a user selection of the traffic flow control object, representing a command to manually toggle the traffic flow direction of the associated entry/exit station; and processing the user command to toggle the traffic flow direction of the associated entry/exit station; and redisplaying the traffic flow control object to indicate the toggled the traffic flow direction of the associated entry/exit station.

8. The method of claim 1, wherein the plurality of control objects includes a vehicle object and a slot object, the method further comprising:

receiving a user selection of the vehicle object and the slot object, representing a user command to manually store the selected vehicle in the selected slot; and controlling the components of the automated parking garage to store the selected vehicle in the selected slot.

9. The method of claim 1, wherein the plurality of control objects includes a vehicle object and an EES object, the method further comprising:

receiving a user selection of the vehicle object and the EES object, representing a user command to manually retrieve the selected vehicle to the EES; and controlling the components of the automated parking garage to retrieve the selected vehicle to the selected EES.

10. The method of claim 1, further comprising identifying an alert, and wherein the plurality of control objects includes a object representing the identified alert.

11. The method of claim 10, wherein the alert represents a safety precaution.

12. The method of claim 10, wherein the alert represents a maintenance need.

13. The method of claim 1, further comprising:

receiving input from at least one EES sensor;

determining a driver instruction based on the received input; and displaying the instruction to the driver of a vehicle in the associated EES.

14. An apparatus for monitoring and controlling an automated parking system using a graphical user interface, comprising:

means for displaying a graphical representation of a floor of an automated parking garage;

means for displaying a plurality of objects in relation to the floor, thereby representing the state of the floor, the plurality of objects representing an entry/exit station (EES), a module for transporting a vehicle along an x-axis, a module for transporting a vehicle along a y-axis, a module for transporting a vehicle along a z-axis, and a plurality of storage racks; and means for displaying a plurality of control objects, each control object associated with controlling an aspect of the automated parking system.

15. The apparatus of claim 14, wherein the plurality of control objects includes an automatic control object, the apparatus further comprising:

means for receiving a user selection of the automatic control object, representing a command to operate the automated parking system according to predefined parameters; and means for controlling associated physical components of the automated parking system according to the predefined parameters.

16. The apparatus of claim 14, wherein the plurality of control objects includes a manual control object, the apparatus further comprising:

means for receiving a user selection of the manual control object, representing a command to operate the automated parking system manually; and means for controlling associated physical components of the automated parking system according to manual instructions received from the user.

17. The apparatus of claim 14, wherein the plurality of control objects includes a halt-all control object, the apparatus further comprising:

means for receiving a user selection of the halt-all control object, representing a command to halt the operation of every component of the automated parking garage; and means for transmitting a signal to every component of the automated parking garage, thereby halting the operation of every component.

18. The apparatus of claim 14, wherein the plurality of control objects includes an emergency stop control object, the apparatus further comprising:

means for receiving a user selection of the emergency stop control object, representing a command to immediately stop the operation of every component of the automated parking garage; and means for transmitting a signal to every component of the automated parking garage, thereby immediately stopping the operation of every component.

19. The apparatus of claim 14, wherein the plurality of control objects includes a diagnostic control object, the apparatus further comprising:

means for receiving a user selection of the diagnostic control object, representing display diagnostic information related to at least one component of the automated parking garage; and means for displaying diagnostic information related to the at least one component of the automated parking garage.

20. The apparatus of claim 14, wherein the plurality of control objects includes an traffic flow control object associated with an entry/exit station, the apparatus further comprising:

means for receiving a user selection of the traffic flow control object, representing a command to manually toggle the traffic flow direction of the associated entry/exit station; and means for processing the user command to toggle the traffic flow direction of the associated entry/exit station; and means for redisplaying the traffic flow control object to indicate the toggled the traffic flow direction of the associated entry/exit station.

21. The apparatus of claim 1, wherein the plurality of control objects includes a vehicle object and a slot object, the apparatus further comprising:

means for receiving a user selection of the vehicle object and the slot object, representing a user command to manually store the selected vehicle in the selected slot; and means for controlling the components of the automated parking garage to store the selected vehicle in the selected slot.

22. The apparatus of claim 14, wherein the plurality of control objects includes a vehicle object and an EES object, the apparatus further comprising:

means for receiving a user selection of the vehicle object and the EES object, representing a user command to manually retrieve the selected vehicle to the EES; and means for controlling the components of the automated parking garage to retrieve the selected vehicle to the selected EES.

23. The apparatus of claim 14, further comprising means for identifying an alert, and wherein the plurality of control objects includes a object representing the identified alert.

24. The apparatus of claim 23, wherein the alert represents a safety precaution.

25. The apparatus of claim 23, wherein the alert represents a maintenance need.

26. The apparatus of claim 1, further comprising:

means for receiving input from at least one EES sensor;

means for determining a driver instruction based on the received input; and means for displaying the instruction to the driver of a vehicle in the associated EES.

27. An apparatus for monitoring and controlling an automated parking system using a graphical user interface, comprising:

a processor;

a memory connected to said processor storing a program to control the operation of said processor;

the processor operative with the program in the memory to:

display a graphical representation of a floor of an automated parking garage;

display a plurality of objects in relation to the floor, thereby representing the state of the floor, the plurality of objects representing an entry/exit station (EES), a module for transporting a vehicle along an x-axis, a module for transporting a vehicle along a y-axis, a module for transporting a vehicle along a z-axis, and a plurality of storage racks; and display a plurality of control objects, each control object associated with controlling an aspect of the automated parking system.

28. A computer-readable storage medium encoded with processing instructions for implementing a method for monitoring and controlling an automated parking system using a graphical user interface, the processing instructions for directing a computer to perform the steps of:

displaying a graphical representation of a floor of an automated parking garage;

displaying a plurality of objects in relation to the floor, thereby representing the state of the floor, the plurality of objects representing an entry/exit station, a module for transporting a vehicle along an x-axis, a module for transporting a vehicle along a y-axis, a module for transporting a vehicle along a z-axis, and a plurality of storage racks; and displaying a plurality of control objects, each control object associated with controlling an aspect of the automated parking system.

* * * * *